US007204588B2

(12) United States Patent
Takabayashi

(10) Patent No.: US 7,204,588 B2
(45) Date of Patent: Apr. 17, 2007

(54) INK JET PRINTED MATTER

(75) Inventor: Toshiyuki Takabayashi, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/317,938

(22) Filed: Dec. 12, 2002

(65) Prior Publication Data

US 2003/0202082 A1 Oct. 30, 2003

(30) Foreign Application Priority Data

Dec. 26, 2001 (JP) ..... 2001-393959
Aug. 9, 2002 (JP) ..... 2002-232783

(51) Int. Cl.
*B41J 2/01* (2006.01)

(52) U.S. Cl. ..... 347/105; 106/31.13

(58) Field of Classification Search ..... 347/102, 347/101, 100, 95, 96, 105; 106/31.6, 31.13, 106/31.27; 428/195; 523/160
See application file for complete search history.

(56) References Cited

U.S. PATENT DOCUMENTS 4,690,858 A * 9/1987 Oka et al. ..... 428/216
4,758,461 A * 7/1988 Akiya et al. ..... 428/32.18
5,232,894 A * 8/1993 Chosa ..... 503/227
5,275,646 A * 1/1994 Marshall et al. ..... 106/31.32
5,539,434 A * 7/1996 Fuse ..... 347/19
5,618,120 A * 4/1997 Ishikawa ..... 400/708
5,757,313 A * 5/1998 Meneghine et al. ..... 347/262
6,179,412 B1 * 1/2001 Ishinaga et al. ..... 347/63
6,347,867 B1 * 2/2002 Lawrence et al. ..... 347/105
6,428,143 B2 * 8/2002 Irihara et al. ..... 347/43
6,457,823 B1 * 10/2002 Cleary et al. ..... 347/102
6,953,245 B2 * 10/2005 Shirakawa ..... 347/102

FOREIGN PATENT DOCUMENTS

JP 361035987 A * 2/1986
JP 5-54667 8/1993
JP 6-200204 7/1994
JP 2000-504778 4/2000

* cited by examiner

*Primary Examiner*—Stephen Meier
*Assistant Examiner*—Ly T. Tran
(74) *Attorney, Agent, or Firm*—Frishauf, Holtz, Goodman & Chick, P.C.

(57) ABSTRACT

A printed mater prepared by jetted ink. The ink is hardened by irradiation of radiation or heat, and the ratio of total thickness of the ink layer to total thickness of the substrate is from 0.40 to 0.05.

9 Claims, No Drawings

INK JET PRINTED MATTER

FIELD OF THE INVENTION

The invention relates to a printed matter printed by ink-jet recording using ink hardenable by irradiation of a radiation or heat, and the printing can be applied on any substrate without variation of the textile feeling thereof.

BACKGROUND OF THE INVENTION

Recently, the ink-jet recording is applied in various fields of printing such as photographic printing, various printing, marking and color filter production since an image can be printed easily with a low cost. Image quality comparable with a silver salt photographic image can be obtained by using a recording apparatus by which a particular fine dot can be controllably jetted, ink improved in the color reproduction range, the durability and the suitability of jetting and exclusive paper considerably improved in the ink absorption ability, the appearance of color and the surface glossiness. The raising of the image quality of the ink-jet recording system of today can be attained only by making set of the recording apparatus, the ink and the exclusive paper.

However, problems of limitation on the recording medium and cost rising of the recording medium are caused in the ink-jet system using the exclusive paper. Many trials have been carried out for recording by ink-jet on a not exclusive image receiving medium. In concrete, systems such as a phase change ink-jet system using wax ink in a solid state in an ordinary temperature, a solvent type ink-jet system using ink mainly composed of a rapid dryable organic solvent and a UV ink-jet system in which the ink is cross-linked by UV light after recording have been tried.

Among them, the UV ink-jet system has been recently noticed since the recording on a recording medium having no rapid drying ability and no ink absorbability can be performed and the odor is lower than that of the solvent type ink-jet system. The UV hardenable type ink for ink-jetting is disclosed in Japanese Patent Examined Publication No. 5-54667, Japanese Patent Publication Open to Public Inspection, hereinafter referred to as JP O.P.I., Nos. 6-200204 and 2000-504778.

However, the value of the printed matter is lowered since curling or waving of the substrate is occurred by hardening shrinking and heat occurred by reaction of the ink when such the ink is provided and irradiated by UV rays on a thin plastic film using for soft packing such as a food package. Moreover, the textile feeling is degraded since the ink is not evaporated after printing and remained as an ink layer on the substrate, and the thickness of the ink layer is made larger than that of the substrate. In the case of the shrinking film, there is a problem such as that the ink layer cannot be followed with the shrinkage of the film since the thickness of the ink layer is large.

It is present condition that the UV ink-jet system is not practically applied for the printing on the soft packing material by the foregoing reason.

SUMMARY OF THE INVENTION

The invention provides a printed matter, ink and an ink-jet recording method by which the ink layer is satisfactorily followed with the substrate without degradation of the textile feeling of the printed matter when an image is printed on any thin layer substrate by the ink-jet recording method using the ink hardenable by irradiation of radiation or heat.

The invention and its embodiment are described.

A printed mater printed by the ink, which is hardened by at least one of irradiation of radiation or heat, jetted from a recording head having at least one nozzle by which jetting of ink droplet can be selectively controlled, wherein the ratio of the total thickness of the ink layer to the total thickness of the substrate is within the range of from 0.40 to 0.05.

The colorant of the ink is preferably a pigment.

An area printed by white ink may be included.

Preferable example of the substrate is a plastic film.

It is preferable that the substrate is a shrinkable film.

The ink is preferably one containing a light-polymerizable mono-functional monomer or oligomer and a light-polymerizable multi-functional monomer or oligomer.

The ink may contain two or more kinds of light-polymerization initiator each having a light absorption different from each other.

Thickness of the substrate is preferably from 8 to 60 μm.

The printed matter may be formed by jetting the ink under a condition of the recording head and the ink are heated at a temperature within the range of from 40 to 100° C.

The printed matter may be formed by solidifying the ink jetted from the recording head and adhered on the substrate by irradiating by radiation having irradiation energy of from 1 to 200 mJ/cm$^2$ at a wavelength of 365 nm.

DETAILED DESCRIPTION OF THE INVENTION

The ink to be used in the invention at least comprises a polymerizable monomer and an initiator. The polymerizable compound includes a radical polymerizable compound and a cationic polymerizable compound.

Various kinds of (meth)acrylate monomer are usable as the radical polymerizable compound. Examples of such the monomer include a mono-functional monomer such as isoamyl acrylate, stearyl acrylate, lauryl acrylate, octyl acrylate, decyl acrylate, isomyristyl acrylate, isostearyl acrylate, 2-ethyl-hexyl diglycol acrylate, 2-hydroxybutyl acrylate, 2-acryloyloxyethylhexahydrophthalic acid, butoxyethyl acrylate, ethoxydiethylene glycol acrylate, methoxydiethylene glycol acrylate, methoxypolyethylene glycol acrylate, methoxypropylene glycol acrylate, phenoxyethyl acrylate, tetrahydrofurfuryl acrylate, isobornyl acrylate, 2-hydroxyethyl acrylate, 2-hydroxypropyl acrylate, 2-hydroxy-3-phenoxypropyl acrylate, 2-acryloyloxyethyl-succinic acid, 2-acryloyloxyethylphthalic acid, 2-acryloyloxyethyl-2-hydroxyethyl-phthalic acid, a lactone-modified elastic acrylate and t-butylcyclohexyl acrylate; a di-functional monomer such as triethylene glycol diacrylate, tetraethylene glycol diacrylate, polyethylene glycol diacrylate, tripropylene glycol diacrylate, polypropylene glycol diacrylate, 1,4-buthanediol diacrylate, 1,6-hexanediol diacrylate, 1,9-nonanediol diacrylate, neopentyl glycol diacrylate, dimethyloltricyclodecane diacrylate, a diacrylate of adduct of bisphenol A with ethylene oxide, a diacrylate of adduct of bisphenol A with polyethylene oxide, hydroxypivalic acid neopentyl glycol diacrylate and polytetramethylene glycol diacrylate; and a tri- or more-functional monomer such as trimethylpropane triacrylate, an ethyl oxide-modified trimethylolpropane triacrylate, pentaerythritol triacrylate, pentaerythritol tetracrylate, di-pentaerythritol hexacrylate, di-trimethylpropane tetracrylate, glycerolpropoxy triacrylate, a caprolactone-modified trimethylolpropane triacrylate, pentaerythritolethoxy tetracrylate and a caprolactam-modified dipentaerythritol hexacrylate.

Furthermore, a polymerizable oligomer may be combined as well as the monomers. Examples of the polymerizable oligomer include an epoxy acrylate, an aliphatic urethane acrylate, an aromatic urethane acrylate, a polyester acrylate, and a straight-chain acryl oligomer.

Among the above-mentioned monomers, the followings are particularly referred from the viewpoint of immunization ability, skin irritability, eye irritability, mutagenic ability and toxicity; isoamyl acrylate, stearyl acrylate, lauryl acrylate, octyl acrylate, decyl acrylate, isomyristyl acrylate, isostearyl acrylate, ethoxydiethylene glycol acrylate, methoxypolyethylene glycol acrylate, methoxypropylene glycol acrylate, isobornyl acrylate, a lactone-modified elastic acrylate, tetraethylene glycol diacrylate, polyethylene glycol diacrylate, polypropylene glycol diacrylate, ethylene oxide-modified trimethylpropane triacrylate, di-pentaerythritol hexacrylate, glycerolpropoxy acrylate, a caprolactone-modified trimethylolpropane triacrylate, pentaerythritolethoxy tetracrylate and a caprolactam-modified di-pentaerythritol hexacrylate.

Moreover, the followings are particularly preferred among the above-mentioned; stearyl acrylate, lauryl acrylate, isostearyl acrylate, ethoxydiethylene glycol acrylate, isobornyl acrylate, tetraethylene glycol diacrylate, an ethylene glycol-modified trimethylolpropane triacrylate, a caprolactone-modified trimethylolpropane triacrylate and a caprolactam-modified di-pentaerythritol hexacrylate.

Various cationic polymerizable compounds can be used in combination as the cationic polymerizable monomer. Examples of such the monomer include epoxy compounds and vinyl ether compounds, and oxetane compounds exemplified in JP O.P.I. Nos. 6-9714, 2001-31892, 2001-40068, 2001-55507, 2001-310938, 2001-310937 and 2001-220526.

Preferred example of the aromatic epoxide is a di- or poly-glycidyl ether produced by reaction of a poly-valent phenol having at least one aromatic nucleus or an alkylene oxide adduct thereof with epichlorohydrin, such as a di- or poly-glycidyl ether of bisphenol A or an alkylene oxide adduct thereof, a di- or poly-glycidyl ether of hydrogenised bisphenol A or an alkylene oxide adduct thereof and a novolak type epoxy resin. In the above, ethylene oxide and propylene oxide are usable as the alkylene oxide.

The aliphatic cyclic epoxide is obtained by epoxidizing a compound having at least one cycloalkane group such as cyclohexane ring and a cyclopentene ring by a suitable oxidant such as hydrogen peroxide and a peracid. A compound containing cyclohexane oxide or cyclopentene oxide is preferable.

An aliphatic poly-valent alcohol and a di- or poly-glycidyl ether of an ethylene oxide adduct thereof is cited as the preferable aliphatic epoxide. Typical examples of such the compound include diglycidyl ether of an alkylene glycol such as diglycidyl ether of ethylene glycol, diglycidyl ether of propylene glycol and diglycidyl ether of 1,6-hexanediol; a poly-glycidyl ether of poly-valent alcohol such as a di- or tri-glycidyl ether of glycerol or an alkylene oxide adduct thereof and a diglycidyl ether of propylene glycol such as a glycidyl ether of polypropylene glycol or an alkylene oxide adduct thereof. Examples of the alkylene oxide in the above-mentioned include ethylene oxide and propylene oxide.

Among the foregoing epoxides, the aromatic epoxide and the aliphatic cyclic epoxide are preferred according to the consideration on the rapid hardening property, and the aliphatic cyclic epoxide is particularly preferred. In the invention, two or more kinds of epoxide may be used in a suitable combination even though a kind of the epoxide may be singly used.

Examples of the vinyl ether compound include a di- or tri-vinyl ether compound such as ethylene glycol di-vinyl ether, diethylene glycol di-vinyl ether, propylene glycol di-vinyl ether, dipropylene glycol di-vinyl ether, butanediol glycol di-vinyl ether, hexanediol glycol di-vinyl ether, cyclohexanedimethanol glycol di-vinyl ether and trimethylpropane tri-vinyl ether; and a mono-vinyl ether compound such as ethyl vinyl ether, n-butyl vinyl ether, isobutyl vinyl ether, octadecyl vinyl ether, cyclohexyl vinyl ether, hydroxybutyl vinyl ether, 2-ethylhexyl vinyl ether, cyclohexanedimethanol mono-vinyl ether, n-propyl vinyl ether, isopropyl vinyl ether, isopropenyl ether-o-propylene carbonate, dodecyl vinyl ether, diethylene glycol mono-vinyl ether and octadecyl vinyl ether.

Among the vinyl ether compounds, the di- and tri-vinyl ether compounds are preferred according to consideration on the hardening ability, the contacting ability and the surface hardness; and the di-vinyl ether is particularly preferred. In the invention, two or more kinds of the foregoing vinyl ether compound may be used in a suitable combination even though a kind of the vinyl ether may be singly used.

The oxetane compound is a compound having an oxetane ring. Any known oxetane compounds such as those disclosed in JP O.P.I. Nos. 2001-220526 and 2001-310937 are usable.

When a compound having five or more oxetane rings is used, the handling of the ink is made difficult since the viscosity of the ink is become too high and the adhesiveness of the hardened material is made insufficient since the glass transition point of the ink is become too high. Accordingly, a compound having from 1 to 4 oxetane rings is preferred.

An example of the compound having one oxetane ring includes a compound represented by the following Formula 1.

Formula 1

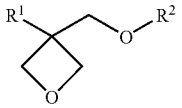

In Formula 1, $R^1$ is a hydrogen atom, an alkyl group having from 1 to 6 carbon atoms such as a methyl group, an ethyl group, a propyl group and a butyl group; a fluoroalkyl group, an allyl group, an aryl group, a furyl group or a thienyl group each having from 1 to 6 carbon atoms. $R^2$ is an alkyl group having from 1 to 6 carbon atoms such as a methyl group, an ethyl group, a propyl group and a butyl group; an alkenyl group having from 2 to 6 carbon atoms such as a 1-propenyl group, a 2-propenyl group, a 2-methyl-1-propenyl group, 2-methyl-2-propenyl group, a 1-butenyl group, a 2-butenyl group and 3-butenyl group; a group having an aromatic ring such as a phenyl group, a benzyl group, a fluorobenzyl group, a methoxybenzyl group and phenoxyethyl group; an alkylcarbonyl group having from 2 to 6 carbon atoms such as an ethylcarbonyl group, a propylcarbonyl group and a butyl carbonyl group; an alkoxycarbonyl group having from 2 to 6 carbon atoms such as an ethoxycarbonyl group, a propoxycarbonyl group, and butoxycarbonyl group; or an N-alkylcarbamoyl group having from 2 to 6 carbon atoms such as an ethylcarbamoyl group, a propylcarbamoyl group, a butylcarbamoyl group and a pentylcarbamoyl group. In the invention, a compound having one oxetane group is preferably used since the composition containing such the compound is superior in the adhesiveness and handling suitability since the composition has a low viscosity.

Examples of the compound having two oxetane rings include ones represented by the following Formula 2.

Formula 2

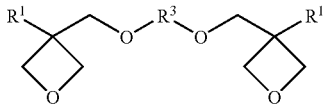

In Formula 2, $R^1$ is synonymous with $R^1$ in Formula 1; and $R^3$ is a linear- or branched-alkylene group such as an ethylene group, a propylene group and a butylenes group; a linear- or branched-poly(alkyleneoxy) group such as a poly (ethyleneoxy) group and a poly(propyleneoxy) group; a linear- or branched-unsaturated carbon hydride group such as a propenylene group, a methylpropenylene group and a butenylene group; a carbonyl group or an alkylene group containing a carbonyl group; an alkylene group or an alkylene group containing a carboxyl group; or an alkylene group containing a carbamoyl group.

As the group represented by $R^3$, a poly-valent group selected from the group represented by the following Formulas 3, 4 or 5 may be cited.

Formula 3

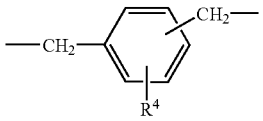

In Formula 3, $R^4$ is a hydrogen atom, an alkyl group having from 1 to 4 carbon atoms such as a methyl group, an ethyl group, a propyl group, and butyl group; an alkoxyl group having from 1 to 4 carbon atoms such as a methoxy group, an ethoxy group, a propoxy group; a halogen atom such as a chlorine atom, a bromine atom; a nitro group; a cyano group; a mercapto group; a lower alkylcarboxyl group; a carboxyl group; or a carbamoyl group.

Formula 4

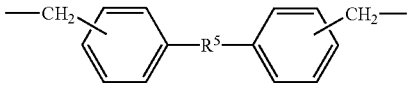

In Formula 4, $R^5$ is an oxygen atom, a sulfur atom, a methylene group, an —NH— group, an $—SO_2$ group, a $=C(CF_3)_2$ group or a $=C(CH_3)_2$ group.

Formula 5

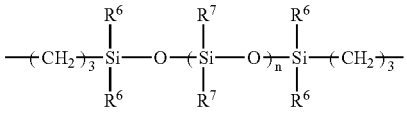

In Formula 5, $R^6$ is an alkyl group having from 1 to 4 carbon atoms such as a methyl group, an ethyl group, a propyl group and a butyl group; or an aryl group. n is an integer from 0 to 2000. $R^7$ is an alkyl group having from 1 to 4 carbon atoms such as a methyl group, an ethyl group, a propyl group and a butyl group; or an aryl group. As $R^7$, a group represented by the following Formula 6 may also be applicable.

Formula 6

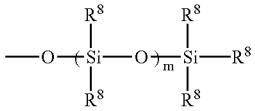

In Formula 6, $R^8$ is an alkyl group having from 1 to 4 carbon atoms such as a methyl group, an ethyl group, a propyl group and a butyl group; or an aryl group. m is an integer from 0 to 100.

Concrete examples of the compound having two oxetane rings are as follows.

Exemplified compound 1

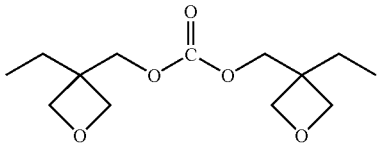

Exemplified compound 2

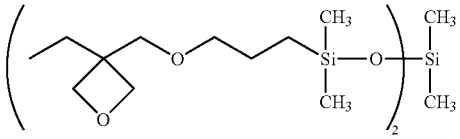

Exemplified compound 1 is a compound represented by Formula 2 in which $R^1$ is an ethyl group and $R^3$ is a carboxyl group. Exemplified compound 2 is a compound represented by Formula 2 in which $R^1$ is an ethyl group and $R^5$ is a group represented by Formula 5. In Formula 5, $R^6$ and $R^7$ are each a methyl group; and n is 1.

Preferable example of the compound having two oxetane rings other than the above-mentioned is a compound represented by the following Formula 7. In Formula 7, $R^1$ is synonymous with $R^1$ in Formula 1.

Formula 7

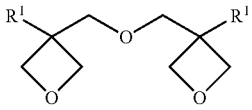

Examples of the compound having 3 to 4 oxetane rings include compounds represented by the following Formula 8.

Formula 8

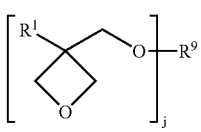

In Formula 8, $R^1$ is synonymous with $R^1$ in Formula 1. $R^9$ is, for example, a branched-alkylene group having from 1 to 12 carbon atoms such as that represented by the following A, B, C or D, or a branched polysiloxyl group represented by the following E. j is an integer of 3 or 4.

A

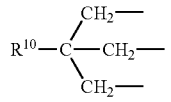

B

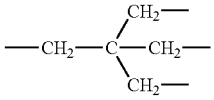

C

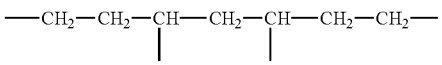

D

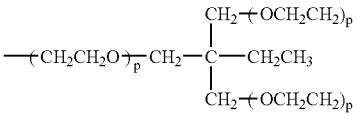

E

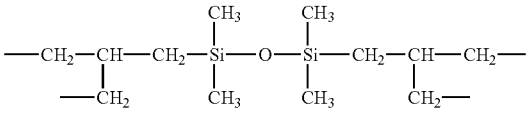

In the above A, $R^{10}$ is a lower alkyl group such as a methyl group, an ethyl group or a propyl group. In the above D, p is an integer of from 1 to 10.

An example of the compound having three to four oxetane rings is Exemplified compound 3.

Exemplified compund 3

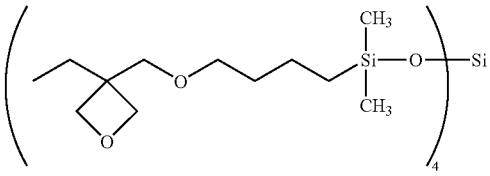

Moreover, examples of the oxetane compound having from 1 to 4 oxetane rings include compounds represented by the following Formula 9.

Formula 9

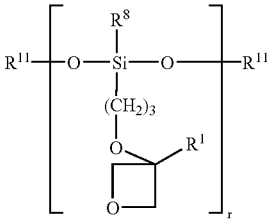

In Formula 9, $R^8$ is synonymous with $R^8$ in the foregoing Formula 6. $R^{11}$ is an alkyl group having from 1 to 4 carbon atoms such as a methyl group, an ethyl group, a propyl group and a butyl group, or a trialkylsilyl group; and r is an integer of from 1 to 4.

Concrete examples of preferable oxetane compound to be used in the invention include the following compounds.

Exemplified compound 4

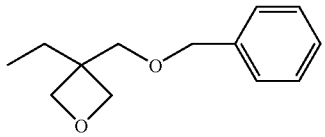

Exemplified compound 5

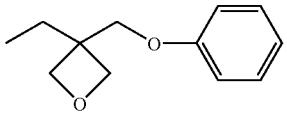

Exemplified compound 6

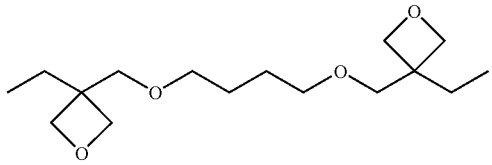

The above-mentioned compounds each having the oxetane ring can be produced by known methods without any limitation, for example, the oxetane ring synthesizing method from diol disclosed by D. B. Pattison, J. Am. Chem. Soc., 3455, 97 (1957). Other than the above-mentioned, a compound having 1 to 4 oxetane rings and a molecular weight of from 1,000 to 5,000 is usable. Concrete examples of such the compound are as follows.

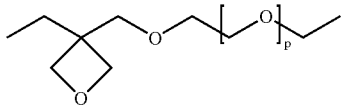

p:20~200

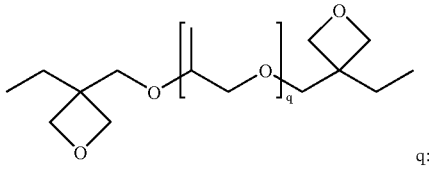

q:15~100

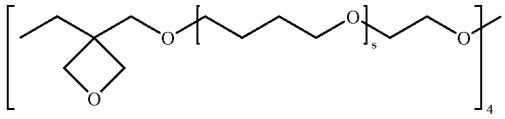

s:20~200

In the invention, it is particularly preferable that the mono-functional monomer, di-functional monomer and a multi-functional monomer having three- or more-functional groups are used in combination for the polymerizable compound. The use of the mono-functional monomer shows a large effect for reducing the shrinking ratio at the time of hardening; and the extrusion stability at the time of ink-jet recording can easily obtained since the ink using such the monomer ha a low viscosity. The di-functional monomer shows a suitable sensitivity and a superior adhesiveness with various recording materials. The multi-functional monomer having three or more functional groups gives a high sensitivity and suitable layer strength after the hardening. Accordingly, prevention of curling and waving caused by the shrink accompanied with the hardening, the adhesion and following with the substrate and the high sensitivity can be attained by the use of these three kinds of monomer. The combination use of the three kinds of the monomer is particularly effective when the shrinking film is used as the substrate; in such the case the substrate is shrunk itself.

It is preferable that the ink composition contains from 5 to 40% by weight of the mono-functional monomer, from 5 to 40% by weight of the di-functional monomer and from 5 to 30% by weight of the multi-functional monomer having three or more functional group. The combination of monomers in which the difference between the maximum value and the minimum value of the solubility parameter, PS, is not less than 1, is preferable for obtaining suitable adhesiveness with various substrate materials and for preventing the curling caused by shrinking accompanied with the hardening. The difference of the PS values is more preferably not less than 1.5.

An aryl-alkyl ketone, an oxime ketone, S-phenyl-thiobenzoic acid, titanocene, an aromatic ketone, thioxantone, a benzyl derivative, a quinine derivative and a ketocumalin can be used as an initiator of photoradical polymerization. The initiator is described in detail in "Application and Market of UV-EB Hardening Technology", edited by Radotech Kenkyuu Kai/supervised by Y. Tabata, CMC Syuppan. It is available in a market such as IRGACURE 184, 907, 1800, 500, 1850, and 651 by CIBA SPECIALTY CHEMICALS, and diethylthioxanthone (DETX-S) by NIPPON KAYAKU Co., Ltd. Among them, an acylphosphine oxide and an acylphosphonate in the name of IRGACURE 1800 and 1850 are particularly effective for internal hardening of an ink image having a thickness of from 5 to 12 μm per color ink since such the initiators each is high in the sensitivity and the light absorption thereof is reduced accompanied with the photo-cleavage of the initiator. In concrete, bis(2,4,6-trimethylbenzoyl)-phenylphosphine oxide and bis(2,6-dimethoxybenzoyl)-2,4,4-trimethyl-pentylphosphine oxide are preferable.

Compounds 1-hydroxy-cyclohexyl phenyl ketone, 2-methyl-1[4-(methylthio)phenyl]-2-morpholinopropane-1-one, bis(2,6-dimethoxybenzoyl)-2,4,4-trimethyl-pentylphosphine oxide and 2-hydroxy-2-methyl-1-phenylpropane-1-one (Darocua (R) 1173) are suitably used from the viewpoint of safety. The adding amount of the compound is preferably from 1 to 6%, more preferably from 2 to 5%, by weight of the whole ink composition. In the invention, it is preferable that the irradiation is separated into two steps different in the wavelength or intensity from each other; and it is particularly preferable that two or more kinds of the initiator different in the absorbing wavelength from each other are used in combination.

As a photo cation initiator, for example, a compound applied in a chemical amplitude type photoresist or photo cation polymerization can be used, cf. "Organic materials for Imaging", ed. Organic electronics material Kenkyuu-Kai, p.p. 187–192, Bunshin Syuppan, 1993. Examples of the compound suitable for the invention are shown below.

Firstly, a salt of $B(C_6F_5)_4^-$, $PF_6^-$, $AsF_6^-$, $SbF_6^-$ or $CF_3SO_3^-$ with an aromatic onium compound such as diazonium, ammonium, iodonium, sulfonium and phosphonium can be cited.

Concrete examples of the onium compound usable in the invention are shown below.

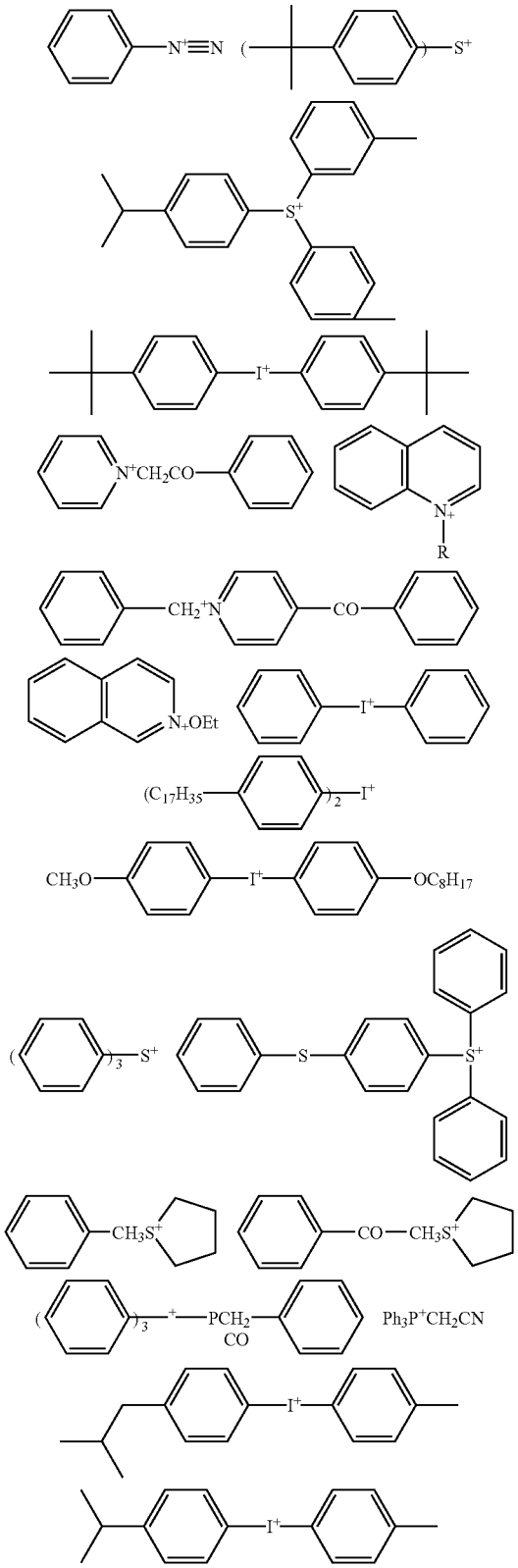

Secondary, a sulfone compound capable of generating a sulfonic acid can be cited; the concrete compounds are shown below.

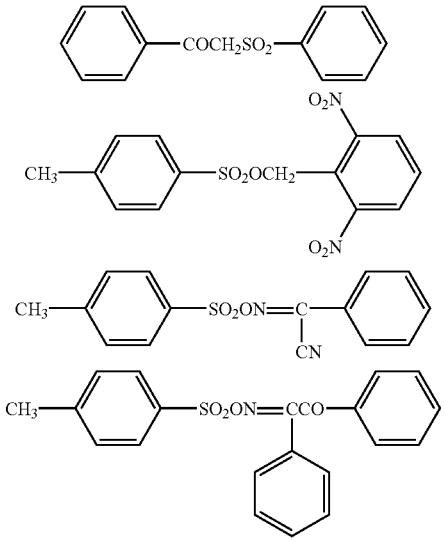

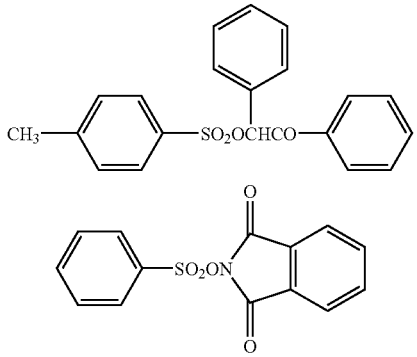

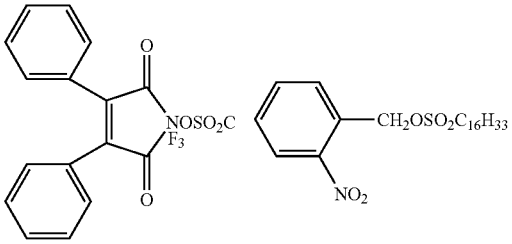

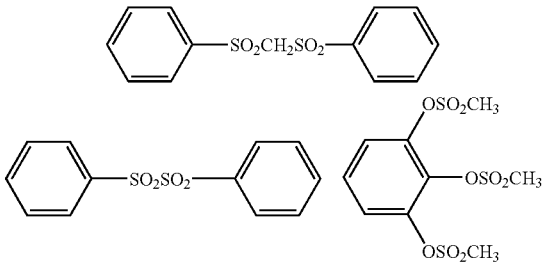

Thirdly, a halogen compound capable of generating a hydrogen halide can also be used; the concrete compounds are shown below.

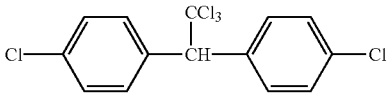

-continued

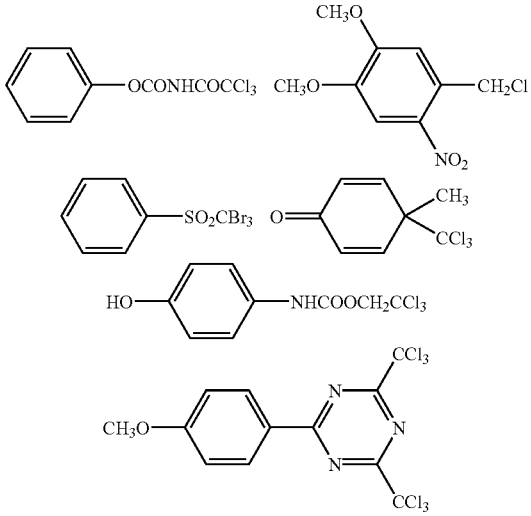

Fourthly, an iron-allene complex can be cited.

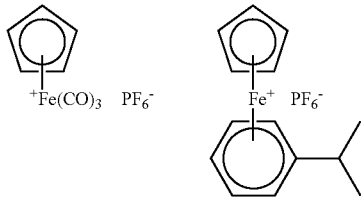

Known acid generation agents are all usable as the acid generation agent. Examples of such the agent include a known compound such as a sulfonium salt type compound, an anilinium salt type compound, a pyridinium salt type compound and phosphonium salt type compound.

As the counter anion of such the onium salt type compounds, $SbF_6^-$, $BF_4^-$, $AsF_6^-$, $PF_6^-$, toluenesulfonate and triflate can be cited.

The ink used in the present invention preferably contains an acid breeding agent which generates an acid by an acid generated by radiation of actinic ray. An improvement in thin layer hardening is available. The examples are described in JP 8-248561A and JP 9-34106A.

The ink used in the present invention preferably contains a thermo base-generating agent for the purpose of improvement in storage ability of ink such as preventing viscosity rising during storage, and stabilizing jetting of the ink jet recording. It is effective particularly for white ink which requires larger amount in jetting.

Examples of the thermo base-generating agent includes a salt of an organic acid and a base, which salt is capable of decarboxylating decomposition reaction upon heating, and a compound capable of releasing amines upon intramolecular nucleophilic reaction, Lossen rearrangement or Beckmann rearrangement, and a compound capable of releasing base upon heating through certain reaction.

Practical compounds include a salt of trichloro acetic acid described in British Patent No. 998,949; a salt of alpha-sulfonyl acetic acid described in U.S. Pat. No. 4,060,420, a salt of propionic acid and a 2-carboxy carboxyamide derivative described in JP 59-168440A, a salt composed of base such as an organic base as well as alkali metal and alkali earth metal, and a thermally decomposition acid described in JP 59-168440A, a hydroxam carbamate employing Lossen rearrangement described in JP 59-180537A, and an aldoxime carbamate which generates nitryl compound upon heating described in JP 59-195237A. Further compounds described in British Patent Nos. 998,949 and 279,480; U.S. Pat. No. 3,220,846, JP 50-22625A, 61-32844A, 61-51139A, 61-52638A, 61-51140A, 61-53634A, 61-53640A, 61-55644A, 61-55645A, and so on are listed as an effective example.

The compound are listed more in detail; guanidine trichloro acetic acid, methyl guanidine trichloro acetic acid, potassium trichloro acetate, guanidine phenylsulfonyl acetic acid, guanidine p-chloro phenylsulfonyl acetic acid, guanidine p-methane phenylsulfonyl acetic acid, potassium phenylpropionate, guanidine phenylpropionic acid, cesium phenylpropionate, guanidine p-chlorophenylpropionic acid, guanidine p-phenylen-bis-phenylpropionic acid, tetramethyl ammonium phenylacetate, and tetramethyl ammonium phenylpropionate.

The thermal base generating agent is used preferably in an amount of from 10 to 1,000 ppm by weight, and more preferably from 20 to 1,000 ppm by weight with reference to whole light polymerizable monomer. The thermal base generating agent is used alone or in combination.

When the ink composition is colored, colorant is additionally added. A colorant capable of being dissolved or dispersed in the main ingredient of the polymerizable compound can be used; and a pigment is preferred from the viewpoint of the weather resistance.

The following pigments are preferably usable.

C.I. Pigment Yellow-1, -3, -12, -13, -14, -17, -81, -83, -95, -109 and -42

C.I. Pigment Orange-16, -36 and -38

C.I. Pigment Red-5, -22, -38, -48:1, -48:2, -48:4, -49:1, -53:1, -57:1, -63:1, -144, -146, -185 and -101

C.I. Pigment Violet-19 and -23

C.I. Pigment Blue-15:1, -15:3, -15:4, -18, -60, -27 and -29

C.I. Pigment Green-7 and -36

C.I. Pigment White-6, -18 and -21

C.I. Pigment Black-7

In the invention it is preferable to use the white pigment for raising the covering ability of the color on a transparent substrate such as a plastic film.

A ball mill, a sand mill, an attriter, a roll mill, an agitator, a Henschel mixer, a colloid mill, an ultrasonic homogenizer, a pearl mill, a wet jet mill and a paint shaker are usable for dispersing the pigment. A dispersant can be added at the time of dispersion of the pigment. A polymer dispersant is preferable as the dispersant. An example of the polymer dispersant is Solsperse series produced by Avecia Co., Ltd. A synergist corresponding to each of the pigments may be used as the dispersing aid. The dispersant and the dispersing aid are preferably added in a ratio of from 1 to 50 parts by weight to 100 parts by weight of the pigment. The dispersion is carried out using a solvent or the polymerizable compound as the dispersion medium. However, it is preferable that the dispersion is performed in the presence of no solvent since the irradiation hardening type ink to be used in the invention is reacted and hardened just after landing onto the recording medium. When the solvent is remained in the hardened image, problems of lowering in the solvent resistance and the VOC of the remained solvent are raised. It is preferable to select the polymerizable compound, particularly the polymerizable compound having the lowest viscosity among the monomers, as the dispersant from the viewpoint of the dispersing suitability.

The average particle diameter of the dispersion is preferably from 0.08 to 0.5 μm; it is preferable to select the pigment, the dispersant and the dispersion medium, the dispersion condition and the filtering condition so that the maximum particle diameter is to be from 0.3 to 10 μm, preferably from 0.3 to 3 μm. The nozzle blocking can be inhibited and the storage stability, the transparency and the hardening sensitivity of the ink can be maintained by such the controlling of the particle diameter. The colorant is preferably added to the ink in an amount of from 1 to 10% by weight of the whole of the ink.

Other Component

For raising the storage ability of the ink, a polymerization preventing agent may be added in an amount of from 200 to 20,000 ppm. In the case of the UV hardenable type ink, the addition of the polymerization preventing agent is preferable to prevent the blocking of the head caused by the thermal polymerization since it is preferable that such the type of ink is heated so that the ink is jetted with lowered viscosity.

Other than the above-mentioned, a surfactant, a matting agent, and a polyester resin, a polyurethane resin, a leveling agent, a vinyl resin, an acryl resin, a rubber type resin and a wax for controlling the layer property may be added according to necessity. For improving the adhesiveness to the recording medium, addition of an extremely slight amount of organic solvent is effective. In such the case, the addition within the range in which the problems of the solvent resistance lowering and the VOC are not raised is effective; the amount of the organic solvent is from 0.1 to 5%, preferably from 0.1 to 3%.

The ink may be made to a radical-cation hybrid hardening type ink by the use of a combination of a cationic polymerizable monomer having a long initiation agent life and the initiator as the means for preventing the lowering of the sensitivity caused by the light shielding by the ink colorant.

The composition of the ink is decided so that the viscosity of the ink is preferably from 7 to 30 mPa·s, more preferably from 7 to 20 mPa·s, at the temperature at jetting time in consideration of jetting out suitability. It is preferable to make the viscosity of the ink at 25° C. to not less than 35 mPa·s. Penetration of the ink in a porous recording medium can be prevented and the unhardened monomer and odor thereof can be reduced and spreading of the dot can be inhibited by raising the viscosity at the room temperature. Thus image quality is improved. The surface tension is preferably from 2 to 3 N/cm, more preferably from 2.3 to 2.8 N/cm.

Image Forming Method

In the image forming method according to the invention, the ink composition is jetted on the substrate by the ink-jet recording system to form an image and then radiation such as UV rays was irradiated to harden the ink.

It is preferable on the stability of jetting out that the head and the ink are heated at a temperature of from 40 to 100° C. to lower the viscosity of the ink for jetting out. The variation of the viscosity accompanied with the temperature change of the radiation hardening type ink is large since the viscosity of such the type of ink is generally higher than that of aqueous ink. The change of the viscosity directly influences on the size and the jetting out speed of the droplet and causes degradation of image quality. Therefore, it is necessary to keep the ink temperature as possible as constant. The control allowance of the temperature is a set temperature ±5° C., preferably the set temperature ±2° C., more preferably the set temperature ±1° C.

The secondary important process is the irradiating condition. Basic irradiation condition is disclosed in JP O.P.I. No. 60-132767. According to the disclosure, light sources are arranged at both sides of the head; and the scanning by the light sources and the head is performed by a shuttle method. Accordingly, the irradiation is carried out after the landing of the ink droplet at a certain interval. Moreover, the hardening is completed by another light source which is not driven. U.S. Pat. No. 6,145,979 discloses an irradiating method using a glass fiber and that in which collimated UV light is reflected by a mirror arranged at a side of the head unit and irradiated to irradiate the recording portion. All of these irradiation methods can be applied in the recording method according to the invention.

In the invention, the duration from the landing of the ink to the irradiation is set a time from 0.01 to 0.3 seconds, more preferably from 0.01 to 0.15 seconds. Spreading of the ink landed onto the substrate before the hardening can be inhibited by controlling the interval of from the landing to the irradiation to be very short. Moreover, the remaining of unreacted monomer is inhibited and the odor thereof can be reduced since the ink can be irradiated before penetrating into the deep interior of the substrate where light can not arrive even when the porous substrate is used. Particularly, a large effect can be obtained when the ink having viscosity of not less than 35 mPa·s is used. The diameter of the landed ink dot can be maintained constant for various substrates different from each other in the wetting ability; and the image quality is raised. It is preferable for obtaining a color image that the colors are piled from the bottom in the order of low lightness thereof. When the ink having a lower lightness is overlapped on the other ink, the radiation difficultly arrive to the lower ink layer; and reducing of the hardening sensitivity, increasing of the remaining monomer and odor thereof and degradation of the adhesiveness of the ink to the substrate tend to be occurred. It is preferable from the viewpoint of acceleration of hardening that the radiation exposure is carried out for every color even though the radiation exposure may be give at once after jetting of the all colors.

UV rays such as UV-A, UV-B and UV-C, vacuum ultraviolet rays, visible rays, γ-ray and β-ray are usable as the radiation.

A high pressure mercury lump, a metal halide lump, a black light, a cold cathode ray tube, a sterilizing lump and LED may be used as the ultraviolet ray source. A heat ray not contributing the reaction such as infrared rays is preferably cut for preventing the curling when the recording is carried out on a thin layer plastic film.

In the invention, the curling and the waving can be improved by separately irradiating for two or more steps by such the radiation and using the ink having the foregoing composition since the adhesiveness and the following ability between the substrate and the ink can be suitable. Sudden shrinkage and heat generation of ink can be inhibited and curling can be prevented by using the ink according to the invention and separating the shrinking and reaction heat generating of the ink into two steps. It is preferable that the intensity and the wavelength of the radiation are changed for every step of the two-step irradiation since the spreading can be prevented and the hardening ratio near the substrate can be raised so as to raise the adhesiveness with the substrate not only prevention of the curling and the waving. It is preferred that light having a larger content of short wavelength component with low intensity is given just after the landing and light having a larger content of long wavelength component with high intensity is given for the post-irradiation.

In the invention, it is preferable that to irradiate active light for hardening the ink is irradiated to form an image so that the irradiation energy at 300 to 380 nm is within the range of from 1 to 200 mJ/cm$^2$.

As the substrate, usual non-coated paper and coated paper not only can be used but also various kinds of plastics and a film thereof to be used for soft packaging. Examples of usable plastics film include a PET film, an OPS film, an OPP film, an ONy film, a PVC film, a PV film and a TAC film. As the plastics other than the above, polycarbonate, acryl resins, ABS, polyacetal, PVA and rubbers are usable. Metals and glass are also usable.

The constitution of the invention is particularly effective when the image is formed on the heat-shrinkable substrates among the foregoing such as the PET film, OPS film, OPP film, ONy film or PVC film. The curling and deformation caused by shrinkage and the generation of reaction heat of the ink are tending to be occurred in such the substrate; and the ink layer is difficultly followed with the shrinking of the substrate.

In the invention, the use of the web-shaped substrate is more advantageous in respect of the cost reducing of the substrate such as the cost of packaging and production, the efficiency of print preparation and the suitability for various print sizes.

In the invention, the printing is performed by the active radiation- or heat-hardenable ink which is jetted out from the recording head having at least one nozzle by which the ink droplet can be selectively jetted out and controlled; and the ratio of the total ink layer thickness to the total thickness of the substrate is within the range of from 0.40 to 0.05. The "total ink layer thickness" is the maximum thickness of the ink layer provided on the substrate. Such the definition is applicable for the case of the ink-jet recording by the mono-color, two-color oiling, three-color piling and four-color piling with a white ink base or a white ink covering. In the usual soft package printing, not only the substrate having a printing surface but a substrate which is composed by a substrate having a printing surface and various substrates laminated on one or both surfaces of such the substrate for various purposes such as providing a gas barrier ability or a light shielding ability are used for obtaining the final printed matter. The "total substrate thickness" is the total of the thickness of the laminated layers of the final printed matter. When the foregoing ratio exceeds 0.40, peeling out and cracking of the ink layer are occurred since the ink layer cannot follow with the substrate, and the textile feeling of the printed matter is considerably degraded since the weight of the ink layer becomes too large. A certain total ink layer thickness is necessary to obtain a satisfactory density for the printed matter. Accordingly the foregoing ratio is inevitably become to not less than 0.05. The thickness of whole substrate is advantageously from 8 to 60 μm in view of obtaining good printed material. At present time, there is no ink-jet system using the radiation- or heat-hardenable ink and applicable for the printed mater having a thin layer substrate such as a soft packaging printed material.

EXAMPLES

Example 1

Composition of Ink

Ink compositions described on Tables 1 through 6 were prepared by the following manner. Parts indicate weight by parts.

The following ingredients are put into a stainless beaker and stirred with heating at 65° C. on a heat plate for one hour to dissolve them.

Solsperse 3200 GR (manufactured by Avecia) 20 parts

Light polymerizable compound shown in Table. Pigment shown in the Table and 200 g of zirconia beads having 1 mm diameter are added thereto and they are shake by a paint shaker to disperse. Zirconia beads are removed and a light polymerization initiator and a sensitizer shown in Table are added, stirred to make mixture. The resultant is filtered with a 0.8 mm membrane filter.

TABLE 1

More preferable Ink composition 1 according to the invention

| Colorant | | K CI pigment Black 7 | C CI pigment Blue 15:3 | M CI pigment Red 57:1 | Y CI pigment Yellow 13 | W Titanium oxide (Anatase type, particle diameter: 0.2 μm) |
|---|---|---|---|---|---|---|
| Colorant | | 3.5 | 2 | 3 | 2.5 | 3.5 |
| Light polymerizable compound | *1 | 25 | 20 | 25 | 20 | 20 |
| Light polymerizable compound | *2 | 32.5 | 38.5 | 34.5 | 35 | 34 |
| Light polymerizable compound | *3 | 30 | 32 | 30 | 35 | 35 |
| Initiator | *4 | 5 | 5 | 5 | 5 | 5 |
| Initiator | *5 | 3.5 | 2 | 2 | 2 | 2 |
| Initiator | *6 | 0.5 | 0.5 | 0.5 | 0.5 | 0.5 |

*1 Lauryl acrylate (mono-functional)
*2 Tetraethylene glycol diacrylate (di-functional)
*3 Caprolactam-modified di-pentaerythritol hexacrylate (hexa-functional)
*4 IRGACURE 1800 (Ciba Specialty Chemicals)
*5 IRGACURE 500 (Ciba Specialty Chemicals)
*6 Diethylthioxanthone

TABLE 2

More preferable Ink composition 2 according to the invention

| Colorant | | K CI pigment Black 7 | C CI pigment Blue 15:3 | M CI pigment Red 57:1 | Y CI pigment Yellow 13 | W Titanium oxide (Anatase type, particle diameter: 0.2 μm) |
|---|---|---|---|---|---|---|
| Colorant | | 5 | 2.5 | 3 | 2.5 | 5 |
| Light polymerizable compound | *1 | 25 | 20 | 25 | 20 | 20 |
| Light polymerizable compound | *2 | 26 | 30 | 29.5 | 30 | 32.5 |
| Light polymerizable compound | *3 | 35 | 40 | 35 | 40 | 35 |
| Initiator | *4 | 5 | 5 | 5 | 5 | 5 |
| Initiator | *5 | 3.5 | 2 | 2 | 2 | 2 |
| Initiator | *6 | 0.5 | 0.5 | 0.5 | 0.5 | 0.5 |

*1 Lauryl acrylate (mono-functional)
*2 Tetraethylene glycol diacrylate (di-functional)
*3 Trimethylolpropane triacrylate (tri-functional)
*4 IRGACURE 1850 (Ciba Specialty Chemicals)
*5 IRGACURE 651 (Ciba Specialty Chemicals)
*6 Diethylthioxanthone

TABLE 3

More preferable Ink composition 3 according to the invention

| Colorant | | K CI pigment Black 7 | C CI pigment Blue 15:3 | M CI pigment Red 57:1 | Y CI pigment Yellow 13 | W Titanium oxide (Anatase type, particle diameter: 0.2 μm) |
|---|---|---|---|---|---|---|
| Colorant | | 5 | 2.5 | 3 | 2.5 | 5 |
| Light polymerizable compound | *1 | 15 | 15 | 15 | 10 | 15 |

TABLE 3-continued

More preferable Ink composition 3 according to the invention

| Colorant | | K CI pigment Black 7 | C CI pigment Blue 15:3 | M CI pigment Red 57:1 | Y CI pigment Yellow 13 | W Titanium oxide (Anatase type, particle diameter: 0.2 μm) |
|---|---|---|---|---|---|---|
| Light polymerizable compound | *2 | 10 | 10 | 10 | 7.5 | 10 |
| Light polymerizable compound | *3 | 19.5 | 22 | 21.5 | 34.5 | 24.5 |
| Light polymerizable compound | *4 | 25 | 25 | 25 | 20 | 20 |
| Light polymerizable compound | *5 | 20 | 20 | 20 | 20 | 20 |
| Initiator | *6 | 5 | 5 | 5 | 5 | 5 |
| Initiator | *7 | 2.4 | 2.4 | 2.4 | 2.4 | 2 |
| Initiator | *8 | 0.5 | 0.5 | 0.5 | 0.5 | 0.5 |

*1 Lauryl acrylate (mono-functional)
*2 Stearyl acrylate (mono-functional)
*3 Tetraethylene glycol diacrylate (di-functional)
*4 Trimethylolpropane triacrylate (tri-functional)
*5 Caprolactam-modified di-pentaerythritol hexacrylate (hexa-functional)
*6 IRGACURE 184 (Ciba Specialty Chemicals)
*7 IRGACURE 907 (Ciba Specialty Chemicals)
*8 Diethylthioxanthone

TABLE 4

Ink composition according to the invention

| Colorant | | K CI pigment Black 7 | C CI pigment Blue 15:3 | M CI pigment Red 57:1 | Y CI pigment Yellow 13 | W Titanium oxide (Anatase type, particle diameter: 0.2 μm) |
|---|---|---|---|---|---|---|
| Colorant | | 5 | 2.5 | 3 | 2.5 | 5 |
| Light polymerizable compound | *1 | 34.5 | 52 | 51.5 | 52 | 34.5 |
| Light polymerizable compound | *3 | 55 | 40 | 40 | 40 | 55 |
| Initiator | *5 | 5 | 5 | 5 | 5 | 5 |
| Initiator | *6 | 0.5 | 0.5 | 0.5 | 0.5 | 0.5 |

*1 Tetraethylene glycol diacrylate (di-functional)
*2 Trimethylolpropane triacrylate (tri-functional)
*3 IRGACURE 184 (Ciba Specialty Chemicals)
*4 Diethylthioxanthone

TABLE 5

More preferable Ink composition 4 according to the invention

| Colorant | | K *1 | C *2 | M *3 | Y *4 | W *5 |
|---|---|---|---|---|---|---|
| Colorant | | 5.0 | 2.5 | 3.0 | 2.5 | 5.0 |
| Light polymerizable compound (epoxided soy bean oil) | DAIMICS 300K (Daicel Kagaku Kougyo) | 20.0 | 15.0 | 15.0 | 15.0 | 20.0 |

TABLE 5-continued

More preferable Ink composition 4 according to the invention

| Colorant | | K *1 | C *2 | M *3 | Y *4 | W *5 |
|---|---|---|---|---|---|---|
| Light polymerizable compound (oxetane compound) | OXT-211 (Toa Gousei) | 64.4 | 74.4 | 73.9 | 74.4 | 66.4 |
| Acid increasing agent | Aqupres 11 (Nihon Chemics) | 3.0 | 3.0 | 3.0 | 3.0 | 3.0 |
| Basic compound | Ethyldiethanolamine | 0.01 | 0.01 | 0.01 | 0.01 | 0.01 |
| Thermally base generating agent | Thermal base 2 | 0.1 | 0.1 | 0.1 | 0.1 | 0.1 |
| Photo-thermally acid generating agent | Initiator 1 | 1.5 | 1.0 | 1.0 | 1.0 | 1.5 |
| Photo acid generating agent | SP152 (Asahi Denka Kogyo) | 5.0 | 3.0 | 3.0 | 3.0 | 3.0 |
| Photo acid generation aid | CS7102 (Nihon Soda) | 1.0 | 1.0 | 1.0 | 1.0 | 1.0 |

*1 CI pigment Black 7
*2 CI pigment Blue 15:3
*3 CI pigment Red 57:1
*4 CI pigment Yellow 13
*5 Titanium oxide
(Anatase type, particle diameter: 0.2 μm)

TABLE 6

More preferable Ink composition 5 according to the invention

| Colorant | | K *1 | C *2 | M *3 | Y *4 | W *5 |
|---|---|---|---|---|---|---|
| Colorant | | 5.0 | 2.5 | 3.0 | 2.5 | 5.0 |
| Light polymerizable compound (epoxided polybutadiene) | Adekaizer-BF-1000 (Asahi Denka Kogyo) | 12.4 | 23.9 | 23.4 | 23.9 | 15.9 |
| Light polymerizable compound (mono-functional oxetane compound) | OXT-211 (Toa Gousei) | 70.0 | 65.0 | 65.0 | 65.0 | 70.0 |
| Acid increasing agent | Compound 1 | 3.0 | 1.5 | 1.5 | 1.5 | 1.5 |
| Thermally base generating agent | Thermal base 1 | 0.1 | 0.1 | 0.1 | 0.1 | 0.1 |
| Photo-thermally acid generating agent | Initiator 2 | 1.5 | 1.0 | 1.0 | 1.0 | 1.5 |
| Photo acid generating agent | CI 5102 (Nihon Soda) | 5.0 | 3.0 | 3.0 | 3.0 | 3.0 |
| Photo acid generation aid | CS 7001 (Nihon Soda) | 3.0 | 3.0 | 3.0 | 3.0 | 3.0 |

*1 CI pigment Black 7
*2 CI pigment Blue 15:3
*3 CI pigment Red 57:1
*4 CI pigment Yellow 13
*5 Titanium oxide
(Anatase type, particle diameter: 0.2 μm)

Initiator 1

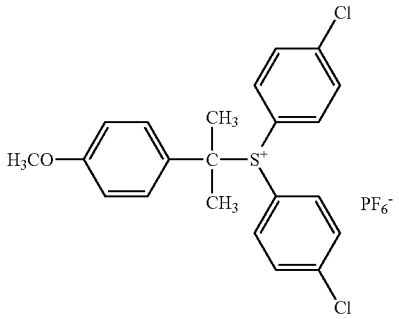

-continued

Initiator 2

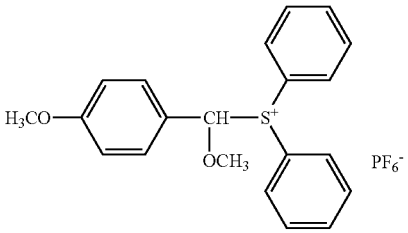

-continued

Thermal base 1

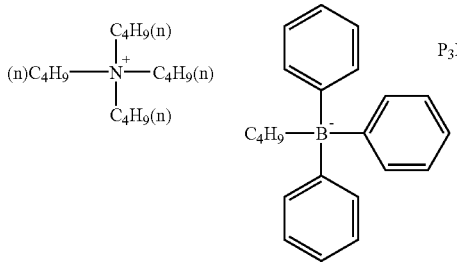

Thermal base 2

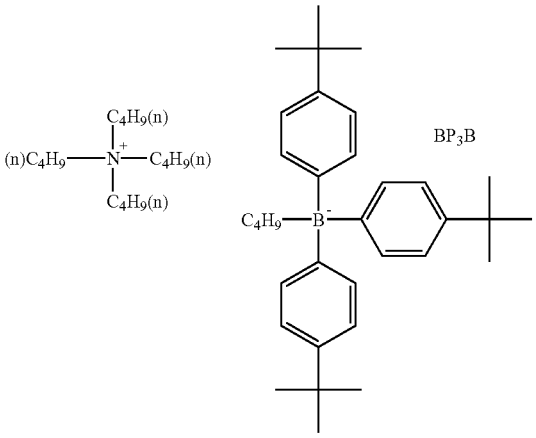

Compound 1

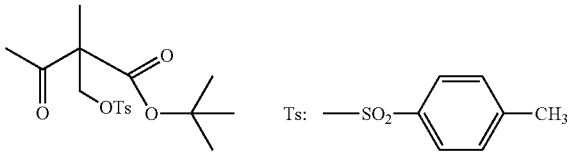

Ink-jet Recording

Recording was carried out on each of the substrates described in Table 7 by an ink-jet recording apparatus using a piezo type ink-jet nozzle. The ink supplying system was constituted by an ink tank, a supplying pipe, a preliminary ink tank provided just before the head, a pipe with a filter and a piezo head; and the part from the preliminary tank to the head was thermally shielded and heated. Thermal sensors were provided at the preliminary tank and near the nozzle of the piezo head; and the temperature was controlled so that the temperature of the nozzle portion was constantly held at 70±2° C. The piezo head was driven so that multi-size dots of from 8 to 30 pl were jetted with the resolution of 720×720 dpi (dpi was dot number per 1 inch or 2.450 cm). The jetting was carried out so that the total ink layer thickness was to be the value shown in Tables 8 through 12. An optical system was arranged in which light of 365 nm from a black light, FL20S-BLB manufactured by Harrison-Toshiba Lighting Co., Ltd., was condensed so that the illuminance at the exposing face was to be 15 mW/cm$^2$ and irradiated from upper side of the head. The irradiation energy was 60 mJ/cm$^2$. Spreading of the ink could be prevented by such the irradiation and a high quality image with no color contamination could be obtained. Next, secondary irradiation was carried out by a metal halide lump of 80 W/cm, M05-L21 manufactured by Eyegraphic Co., Ltd. The irradiation was carried out so that the illuminance at the exposing face was to be 80 mW/cm$^2$ at 365 nm and the irradiation energy was to be 150 mJ/cm$^2$. The ink can be hardened until interior thereof; and satisfactory durability and the adhesiveness with the substrate could be obtained by the secondary irradiation.

TABLE 7

| Substrate | Example of use | | Substrate on which ink is directly printed (Layer 1) | Printing ink (Layer 2) | Layer 3 | Layer 4 | Layer 5 | Layer 6 | Layer 7 | Total thickness of substrate |
|---|---|---|---|---|---|---|---|---|---|---|
| 1 | Bag for instant noodle | Outside | OPP | Printing ink | Adhesive agent | PE | | | | 35 |
| 2 | Bag for tooth powder | Outside | Printing ink | White PE | Paper | EAA | Aluminum foil | EAA | PE | 80 |
| 3 | Bag for retort food | Outside | ONy | Printing ink | Adhesive agent | CPP | | | | 40 |
| 4 | Bag for potato chips | Outside | OPP | Adhesive agent | Vacuum evaporated aluminum | CPP | | | | 45 |
| 5 | Wrapping sheet for candy | Outside | HDPE | Printing ink | Adhesive agent | Aluminum foil | | | | 35 |
| 6 | Bag for poultice | Outside | PET | Printing ink | Aluminum foil | Adhesive agent | | | | 55 |
| 7 | Packing for medicine tablet | Outside | Cellophane | Printing ink | Adhesive agent | LDPE | | | | 35 |
| 8 | Shrinkable label | Outside | Shrinkable PET | Printing ink | | | | | | 50 |
| 9 | Shrinkable label | Outside | Shrinkable OPS | Printing ink | | | | | | 60 |
| 10 | Shrinkable label | Outside | Shrinkable PVC | Printing ink | | | | | | 60 |

TABLE 7-continued

| Sub-strate | Example of use | | Substrate on which ink is directly printed (Layer 1) | Printing ink (Layer 2) | Layer 3 | Layer 4 | Layer 5 | Layer 6 | Layer 7 | Total thickness of substrate |
|---|---|---|---|---|---|---|---|---|---|---|
| 11 | Usual label | Outside | Printing ink | Tacking paper (surface substrate: OPP) | | | | | | 100 |
| 12 | Wine label | Outside | Printing ink | Japanese paper | | | | | | 90 |

OPP: oriented polypropylene
PE: polyethylene
EAA: ethylene acryl acid
ONy: oriented nylon
CPP: cast polypropylene
HDPE: high density polyethylene
PET: polyester
PAN: polyacrylonitrile
LDPE: low density polyethylene
OPS: oriented polystyrene
PVC: polyvinylchloride
Adhesion: A 100% solid urethane non-solvent adhesive agent was heated for lowering the viscosity and coated on the substrate, and another substrate was pressed by a pressure roller onto the coated surface of the adhesive agent to be adhered (according to the method usually applied in the soft packaging field).

As is described in Tables 8 through 12, irradiation of 120 mW/cm$^2$ at 365 nm and exposure energy of 150 mL/cm$^2$ was carried out just after lading of the ink using a metal halide lump of 80 W/cm, M05-L21, manufactured by Eyegraphic Co., Ltd., for comparison.

The substrate after printing was made to the usual packing state as shown in Table 7.

Evaluation Items (Following Ability of Ink Layer)

The printed matter was bent just after the printing and peeling, cracking and fissuring of the ink layer caused by the bending were visually evaluated.

A: Excellent

B: Fair (a level of barely acceptable for practical use)

C: Poor (Wrinkle and Curl of Printed Matter)

The printed matter was taken in hand just after the printing and occurrence of wrinkle and curl caused by the irradiation and hardening were visually evaluated.

A: Excellent

B: Fair (a level of barely acceptable for practical use)

C: Poor, wrinkles and curling were observed on the printed matter.

(Textile Feeling of Printed Matter)

The printed matter was taken in hand just after the printing and the difference of the touch feeling before and after the printing was evaluated.

A: Excellent

B: Fair (a level of barely acceptable for practical use)

C: Poor, the textile feeling was apparently differed by the ink layer.

TABLE 8

| Sample No. | Ink | Total ink thickness (μm) | Substrate | *1 |
|---|---|---|---|---|
| 1 | Ink according to the invention | 21 | Substrate 1 | 0.60 |
| 2 | Ink according to the invention | 21 | Substrate 2 | 0.26 |
| 3 | Ink according to the invention | 21 | Substrate 3 | 0.53 |
| 4 | Ink according to the invention | 21 | Substrate 4 | 0.47 |
| 5 | Ink according to the invention | 21 | Substrate 5 | 0.60 |
| 6 | Ink according to the invention | 21 | Substrate 6 | 0.38 |
| 7 | Ink according to the invention | 21 | Substrate 7 | 0.60 |
| 8 | Ink according to the invention | 21 | Substrate 8 | 0.42 |
| 9 | Ink according to the invention | 21 | Substrate 9 | 0.35 |
| 10 | Ink according to the invention | 21 | Substrate 10 | 0.35 |
| 11 | Ink according to the invention | 21 | Substrate 11 | 0.21 |
| 12 | Ink according to the invention | 21 | Substrate 12 | 0.23 |
| 13 | Ink according to the invention | 16 | Substrate 1 | 0.46 |
| 14 | Ink according to the invention | 16 | Substrate 2 | 0.20 |
| 15 | Ink according to the invention | 16 | Substrate 3 | 0.40 |
| 16 | Ink according to the invention | 16 | Substrate 4 | 0.36 |
| 17 | Ink according to the invention | 16 | Substrate 5 | 0.46 |

| Sample No. | Irradiation condition | Following ability of ink layer | Wrinkle and curl of printed matter | Textile feeling of printing matter | Remarks |
|---|---|---|---|---|---|
| 1 | Black light + Metal halide lump | C | B | C | Comparative |

TABLE 8-continued

| | | | | | |
|---|---|---|---|---|---|
| 2 | Black light + Metal halide lump | A | A | A | Inventive |
| 3 | Black light + Metal halide lump | C | B | C | Comparative |
| 4 | Black light + Metal halide lump | C | B | C | Comparative |
| 5 | Black light + Metal halide lump | C | B | C | Comparative |
| 6 | Black light + Metal halide lump | B | A | A | Inventive |
| 7 | Black light + Metal halide lump | C | B | C | Comparative |
| 8 | Black light + Metal halide lump | C | B | C | Comparative |
| 9 | Black light + Metal halide lump | B | A | A | Inventive |
| 10 | Black light + Metal halide lump | B | A | A | Inventive |
| 11 | Black light + Metal halide lump | A | A | A | Inventive |
| 12 | Black light + Metal halide lump | A | A | A | Inventive |
| 13 | Black light + Metal halide lump | B | B | C | Comparative |
| 14 | Black light + Metal halide lump | A | A | A | Inventive (preferable example) |
| 15 | Black light + Metal halide lump | A | A | A | Inventive (preferable example) |
| 16 | Black light + Metal halide lump | A | A | A | Inventive (preferable example) |
| 17 | Black light + Metal halide lump | B | B | C | Comparative |

*1 Total ink layer thickness/total substrate thickness

TABLE 9

| Sample No. | Ink | Total ink thickness (μm) | Substrate | *1 |
|---|---|---|---|---|
| 18 | Ink according to the invention | 16 | Substrate 6 | 0.29 |
| 19 | Ink according to the invention | 16 | Substrate 7 | 0.46 |
| 20 | Ink according to the invention | 16 | Substrate 8 | 0.32 |
| 21 | Ink according to the invention | 16 | Substrate 9 | 0.27 |
| 22 | Ink according to the invention | 16 | Substrate 10 | 0.27 |
| 23 | Ink according to the invention | 16 | Substrate 11 | 0.16 |
| 24 | Ink according to the invention | 16 | Substrate 12 | 0.18 |
| 25 | Ink according to the invention | 14 | Substrate 1 | 0.40 |
| 26 | Ink according to the invention | 14 | Substrate 2 | 0.18 |
| 27 | Ink according to the invention | 14 | Substrate 3 | 0.35 |
| 28 | Ink according to the invention | 14 | Substrate 4 | 0.31 |

| Sample No. | Irradiation condition | Following ability of ink layer | Wrinkle and curl of printed matter | Textile feeling of printing matter | Remarks |
|---|---|---|---|---|---|
| 18 | Black light + Metal halide lump | A | A | A | Inventive (preferable example) |
| 19 | Black light + Metal halide lump | B | B | C | Comparative |
| 20 | Black light + Metal halide lump | A | B | A | Inventive (preferable example) |
| 21 | Black light + Metal halide lump | A | B | A | Inventive (preferable example) |
| 22 | Black light + Metal halide lump | A | B | A | Inventive (preferable example) |
| 23 | Black light + Metal halide lump | A | A | A | Inventive (preferable example) |
| 24 | Black light + Metal halide lump | A | A | A | Inventive (preferable example) |
| 25 | Black light + Metal halide lump | B | A | B | Inventive (preferable example) |
| 26 | Black light + Metal halide lump | A | A | A | Inventive (preferable example) |
| 27 | Black light + Metal halide lump | B | A | A | Inventive (preferable example) |

TABLE 9-continued

| | | | | | |
|---|---|---|---|---|---|
| 28 | Black light + Metal halide lump | A | A | A | Inventive (preferable example) |

*1 Total ink layer thickness/total substrate thickness

TABLE 10

| Sample No. | Ink | Total ink thickness (μm) | Substrate | *1 |
|---|---|---|---|---|
| 29 | Ink according to the invention | 14 | Substrate 5 | 0.40 |
| 30 | Ink according to the invention | 14 | Substrate 6 | 0.25 |
| 31 | Ink according to the invention | 14 | Substrate 7 | 0.40 |
| 32 | Ink according to the invention | 14 | Substrate 8 | 0.28 |
| 33 | Ink according to the invention | 14 | Substrate 9 | 0.23 |
| 34 | Ink according to the invention | 14 | Substrate 10 | 0.23 |
| 35 | Ink according to the invention | 14 | Substrate 11 | 0.14 |
| 36 | Ink according to the invention | 14 | Substrate 12 | 0.16 |
| 37 | Ink according to the invention | 14 | Substrate 1 | 0.40 |
| 38 | Ink according to the invention | 14 | Substrate 2 | 0.18 |
| 39 | Ink according to the invention | 14 | Substrate 3 | 0.35 |

| Sample No. | Irradiation condition | Following ability of ink layer | Wrinkle and curl of printed matter | Textile feeling of printing matter | Remarks |
|---|---|---|---|---|---|
| 29 | Black light + Metal halide lump | B | A | B | Inventive (preferable example) |
| 30 | Black light + Metal halide lump | A | A | A | Inventive (preferable example) |
| 31 | Black light + Metal halide lump | B | A | B | Inventive (preferable example) |
| 32 | Black light + Metal halide lump | A | A | A | Inventive (preferable example) |
| 33 | Black light + Metal halide lump | A | B | A | Inventive (preferable example) |
| 34 | Black light + Metal halide lump | A | A | A | Inventive (preferable example) |
| 35 | Black light + Metal halide lump | A | A | A | Inventive (preferable example) |
| 36 | Black light + Metal halide lump | A | A | A | Inventive (preferable example) |
| 37 | Black light + Metal halide lump | A | A | B | Inventive (preferable example) |
| 38 | Black light + Metal halide lump | A | A | A | Inventive (preferable example) |
| 39 | Black light + Metal halide lump | A | A | A | Inventive (preferable example) |

*1 Total ink layer thickness/total substrate thickness

TABLE 11

| Sample No. | Ink | Total ink thickness (μm) | Substrate | *1 |
|---|---|---|---|---|
| 40 | Ink according to the invention | 14 | Substrate 4 | 0.31 |
| 41 | Ink according to the invention | 14 | Substrate 5 | 0.40 |
| 42 | Ink according to the invention | 14 | Substrate 6 | 0.25 |
| 43 | Ink according to the invention | 14 | Substrate 7 | 0.40 |
| 44 | Ink according to the invention | 14 | Substrate 8 | 0.28 |
| 45 | Ink according to the invention | 14 | Substrate 9 | 0.23 |
| 46 | Ink according to the invention | 14 | Substrate 10 | 0.23 |
| 47 | Ink according to the invention | 14 | Substrate 11 | 0.14 |
| 48 | Ink according to the invention | 14 | Substrate 12 | 0.16 |
| 49 | Ink according to the invention | 14 | Substrate 1 | 0.40 |
| 50 | Ink according to the invention | 14 | Substrate 8 | 0.28 |

| Sample No. | Irradiation condition | Following ability of ink layer | Wrinkle and curl of printed matter | Textile feeling of printing matter | Remarks |
|---|---|---|---|---|---|
| 29 | Black light + Metal halide lump | A | A | A | Inventive (preferable example) |

TABLE 11-continued

| | | | | | |
|---|---|---|---|---|---|
| 30 | Black light + Metal halide lump | A | A | B | Inventive (preferable example) |
| 31 | Black light + Metal halide lump | A | A | A | Inventive (preferable example) |
| 32 | Black light + Metal halide lump | A | A | B | Inventive (preferable example) |
| 33 | Black light + Metal halide lump | A | A | A | Inventive (preferable example) |
| 34 | Black light + Metal halide lump | A | A | A | Inventive (preferable example) |
| 35 | Black light + Metal halide lump | A | A | A | Inventive (preferable example) |
| 36 | Black light + Metal halide lump | A | A | A | Inventive (preferable example) |
| 37 | Black light + Metal halide lump | A | A | A | Inventive (preferable example) |
| 38 | Metal halide lump only | A | A | B | Inventive |
| 39 | Metal halide lump only | A | B | A | Inventive |

*1 Total ink layer thickness/total substrate thickness

TABLE 12

| Sample No. | Ink | Total ink thickness (μm) | Substrate | *1 | Irradiation condition |
|---|---|---|---|---|---|
| 51 | *2 | 14 | Substrate 9 | 0.23 | Metal halide lump only |
| 52 | *2 | 14 | Substrate 10 | 0.23 | Metal halide lump only |
| 53 | *3 | 12 | Substrate 1 | 0.34 | Metal halide lump only |
| 54 | *3 | 12 | Substrate 2 | 0.15 | Metal halide lump only |
| 55 | *3 | 12 | Substrate 3 | 0.30 | Metal halide lump only |
| 56 | *3 | 12 | Substrate 4 | 0.27 | Metal halide lump only |
| 57 | *3 | 12 | Substrate 5 | 0.34 | Metal halide lump only |
| 58 | *3 | 12 | Substrate 6 | 0.22 | Metal halide lump only |
| 59 | *3 | 12 | Substrate 7 | 0.34 | Metal halide lump only |
| 60 | *3 | 12 | Substrate 8 | 0.24 | Metal halide lump only |
| 61 | *3 | 12 | Substrate 9 | 0.20 | Metal halide lump only |
| 62 | *3 | 12 | Substrate 10 | 0.20 | Metal halide lump only |
| 63 | *3 | 12 | Substrate 11 | 0.12 | Metal halide lump only |
| 64 | *3 | 12 | Substrate 12 | 0.13 | Metal halide lump only |
| 65 | *4 | 12 | Substrate 1 | 0.34 | Metal halide lump only |
| 66 | *4 | 12 | Substrate 2 | 0.15 | Metal halide lump only |
| 67 | *4 | 12 | Substrate 3 | 0.30 | Metal halide lump only |
| 68 | *4 | 12 | Substrate 4 | 0.27 | Metal halide lump only |
| 69 | *4 | 12 | Substrate 5 | 0.34 | Metal halide lump only |
| 70 | *4 | 12 | Substrate 6 | 0.22 | Metal halide lump only |
| 71 | *4 | 12 | Substrate 7 | 0.34 | Metal halide lump only |
| 72 | *4 | 12 | Substrate 8 | 0.24 | Metal halide lump only |
| 73 | *4 | 12 | Substrate 9 | 0.20 | Metal halide lump only |
| 74 | *4 | 12 | Substrate 10 | 0.20 | Metal halide lump only |
| 75 | *4 | 12 | Substrate 11 | 0.12 | Metal halide lump only |
| 76 | *4 | 12 | Substrate 12 | 0.13 | Metal halide lump only |

| Sample No. | Following ability of ink layer | Wrinkle and curl of printed matter | Textile feeling of printing matter | Remarks |
|---|---|---|---|---|
| 51 | A | B | A | Inventive |
| 52 | A | B | A | Inventive |
| 53 | B | A | A | Inventive |
| 54 | A | A | A | Inventive |
| 55 | A | A | A | Inventive |
| 56 | A | A | A | Inventive |
| 57 | B | A | A | Inventive |
| 58 | A | A | A | Inventive |
| 59 | B | A | A | Inventive |
| 60 | A | A | A | Inventive |
| 61 | A | A | A | Inventive |
| 62 | A | A | A | Inventive |
| 63 | A | A | A | Inventive |
| 64 | A | A | A | Inventive |
| 65 | A | A | A | Inventive |
| 66 | A | A | A | Inventive |
| 67 | A | A | A | Inventive |
| 68 | A | A | A | Inventive |
| 69 | B | A | A | Inventive |

TABLE 12-continued

| | | | | |
|---|---|---|---|---|
| 70 | A | A | A | Inventive |
| 71 | B | A | A | Inventive |
| 72 | A | A | A | Inventive |
| 73 | A | A | A | Inventive |
| 74 | A | A | A | Inventive |
| 75 | A | A | A | Inventive |
| 76 | A | A | A | Inventive |

*1 Total ink layer thickness/total substrate thickness
*2 More preferable ink of the invention 3
*3 More preferable ink of the invention 4
*4 More preferable ink of the invention 5

From Tables 8 through 12, it is understood that the samples according to the invention are printed matters in each of which the ink layer is satisfactorily followed to the substrate without any degradation of the textile feeling even when the printing was carried out on every thin layer substrate by jetting the ink hardenable by radiation irradiation or heat.

The printed matter in which the ink layer is satisfactory followed to the substrate without any degradation of the textile feeling, the ink and the ink-jet recording method can be provided by the invention.

The invention claimed is:

1. A printed matter comprising a substrate and an ink layer defining an image and consisting of irradiation hardened jetted ink, wherein said image is printed by jetted ink which contains a light-polymerizable mono-functional monomer or oligomer, and a light-polymerizable multi-functional monomer or oligomer, and is hardened by irradiation of radiation or heat to form said ink layer, and wherein the ratio of total thickness of the ink layer to total thickness of the substrate is from 0.40 to 0.05.

2. The printed matter of claim 1, wherein the image is formed by jetting ink from a recording head having a nozzle by which jetting of ink droplets can be selectively controlled.

3. The printed matter of claim 1, wherein the ink contains a pigment.

4. The printed matter of claim 1, wherein the printed matter has an area printed by white ink.

5. The printed matter of claim 1, wherein the substrate is a plastic film.

6. The printed matter of claim 1, wherein the substrate is a shrinkable film.

7. The printed matter of claim 1, wherein the ink contains two or more kinds of light-polymerization initiator each having a light absorption different from each other.

8. The printed matter of claim 1, wherein the printed matter is formed by jetting the ink under a condition that the recording head and the ink are heated at a temperature within the range of from 40 to 100° C.

9. The printed matter of claim 1, wherein the thickness of the ink layer is from 5 to 12 μm per color ink of the ink layer.

* * * * *